US011728576B2

(12) United States Patent
Brandenburg et al.

(10) Patent No.: US 11,728,576 B2
(45) **Date of Patent: *Aug. 15, 2023**

(54) PLASTIC AIR-WAVEGUIDE ANTENNA WITH CONDUCTIVE PARTICLES

(71) Applicant: Aptiv Technologies Limited, St. Michael (BB)

(72) Inventors: Scott D. Brandenburg, Kokomo, IN (US); Mark W. Hudson, Russiaville, IN (US); David W. Zimmerman, Noblesville, IN (US)

(73) Assignee: Aptiv Technologies Limited, St. Michael (BB)

( * ) Notice: Subject to any disclaimer, the term of this patent is extended or adjusted under 35 U.S.C. 154(b) by 0 days.

This patent is subject to a terminal disclaimer.

(21) Appl. No.: 17/663,163

(22) Filed: May 12, 2022

(65) Prior Publication Data

US 2022/0271437 A1 Aug. 25, 2022

Related U.S. Application Data

(63) Continuation of application No. 17/061,675, filed on Oct. 2, 2020, now Pat. No. 11,362,436.

(51) Int. Cl.
*H01Q 21/00* (2006.01)
*H01Q 1/22* (2006.01)

(52) U.S. Cl.
CPC ..... *H01Q 21/0087* (2013.01); *H01Q 1/2283* (2013.01); *H01Q 21/005* (2013.01); *H01Q 21/0043* (2013.01); *H01Q 21/0068* (2013.01)

(58) Field of Classification Search
CPC ..... H01Q 21/0087; H01Q 1/2283; H01Q 21/005; H01Q 21/0043; H01Q 21/0068; H01P 11/00
See application file for complete search history.

(56) References Cited

U.S. PATENT DOCUMENTS 3,462,713 A 8/1969 Knerr
3,579,149 A 5/1971 Ramsey
(Continued)

FOREIGN PATENT DOCUMENTS

CA 2654470 A1 12/2007
CN 1620738 A 5/2005
(Continued)

OTHER PUBLICATIONS

"Extended European Search Report", EP Application No. 18153137.7, dated Jun. 15, 2018, 8 pages.
(Continued)

*Primary Examiner* — Vibol Tan
(74) *Attorney, Agent, or Firm* — Sawtooth Patent Group PLLC

(57) ABSTRACT

This document describes techniques and apparatuses for a plastic air-waveguide antenna with conductive particles. The described antenna includes an antenna body made from a resin embedded with conductive particles, a surface of the antenna body that includes a resin layer with no or fewer conductive particles, and a waveguide structure. The waveguide structure can be made from a portion of the surface on which the embedded conductive particles are exposed. The waveguide structure can be molded as part of the antenna body or cut into the antenna body using a laser, which also exposes the conductive particles. If the waveguide is molded as part of the antenna body, the conductive particles can be exposed by an etching process or by using the laser. In this way, the described apparatuses and techniques can reduce weight, improve gain and phase control, improve high-temperature performance, and avoid at least some vapor-deposition plating operations.

20 Claims, 5 Drawing Sheets

(56) References Cited

U.S. PATENT DOCUMENTS

| | | | |
|---|---|---|---|
| 4,157,516 | A | 6/1979 | Grijp |
| 4,453,142 | A | 6/1984 | Murphy |
| 4,562,416 | A | 12/1985 | Sedivec |
| 5,982,256 | A | 11/1999 | Uchimura et al. |
| 5,986,527 | A | 11/1999 | Ishikawa et al. |
| 6,489,855 | B1 | 12/2002 | Kitamori et al. |
| 6,794,950 | B2 | 9/2004 | Toit et al. |
| 6,867,660 | B2 | 3/2005 | Kitamori et al. |
| 6,958,662 | B1 | 10/2005 | Salmela et al. |
| 7,973,616 | B2 | 7/2011 | Shijo et al. |
| 7,994,879 | B2 | 8/2011 | Kim et al. |
| 8,013,694 | B2 | 9/2011 | Hiramatsu et al. |
| 8,089,327 | B2 | 1/2012 | Margomenos et al. |
| 8,159,316 | B2 | 4/2012 | Miyazato et al. |
| 8,692,731 | B2 | 4/2014 | Lee et al. |
| 9,007,269 | B2 | 4/2015 | Lee et al. |
| 9,450,281 | B2 | 9/2016 | Kim |
| 9,673,532 | B2 * | 6/2017 | Cheng ..... H01Q 13/06 |
| 9,935,065 | B1 | 4/2018 | Baheti et al. |
| 10,468,736 | B2 * | 11/2019 | Mangaiahgari ..... G01S 13/0209 |
| 10,651,541 | B1 | 5/2020 | Hayes et al. |
| 10,713,450 | B2 | 7/2020 | Hunziker |
| 10,775,573 | B1 | 9/2020 | Hsu et al. |
| 10,833,385 | B2 | 11/2020 | Mangaiahgari |
| 11,362,436 | B2 * | 6/2022 | Brandenburg ..... H01Q 21/0068 |
| 2002/0021197 | A1 | 2/2002 | Elco |
| 2004/0069984 | A1 | 4/2004 | Estes et al. |
| 2004/0222924 | A1 | 11/2004 | Dean et al. |
| 2006/0113598 | A1 | 6/2006 | Chen et al. |
| 2008/0129409 | A1 | 6/2008 | Nagaishi et al. |
| 2008/0150821 | A1 | 6/2008 | Koch et al. |
| 2009/0207090 | A1 | 8/2009 | Pettus et al. |
| 2009/0243762 | A1 | 10/2009 | Chen et al. |
| 2012/0013421 | A1 | 1/2012 | Hayata |
| 2012/0050125 | A1 | 3/2012 | Leiba et al. |
| 2012/0068316 | A1 | 3/2012 | Ligander |
| 2012/0163811 | A1 | 6/2012 | Doany et al. |
| 2012/0242421 | A1 | 9/2012 | Robin et al. |
| 2012/0256796 | A1 | 10/2012 | Leiba |
| 2013/0057358 | A1 | 3/2013 | Anthony et al. |
| 2014/0015709 | A1 | 1/2014 | Shijo et al. |
| 2014/0091884 | A1 | 4/2014 | Flatters |
| 2014/0106684 | A1 | 4/2014 | Burns et al. |
| 2015/0097633 | A1 | 4/2015 | Devries et al. |
| 2015/0229017 | A1 | 8/2015 | Suzuki et al. |
| 2015/0357698 | A1 | 12/2015 | Kushta |
| 2015/0364804 | A1 | 12/2015 | Tong et al. |
| 2015/0364830 | A1 | 12/2015 | Tong et al. |
| 2016/0043455 | A1 | 2/2016 | Seler et al. |
| 2016/0049714 | A1 | 2/2016 | Ligander et al. |
| 2016/0118705 | A1 | 4/2016 | Tang et al. |
| 2016/0204495 | A1 | 7/2016 | Takeda et al. |
| 2016/0276727 | A1 | 9/2016 | Dang et al. |
| 2016/0293557 | A1 | 10/2016 | Topak et al. |
| 2016/0301125 | A1 | 10/2016 | Kim et al. |
| 2017/0062298 | A1 | 3/2017 | Auchere et al. |
| 2017/0084554 | A1 | 3/2017 | Dogiamis et al. |
| 2017/0324135 | A1 | 11/2017 | Blech et al. |
| 2018/0131084 | A1 | 5/2018 | Park et al. |
| 2018/0226709 | A1 | 8/2018 | Mangaiahgari |
| 2018/0233465 | A1 | 8/2018 | Spella et al. |
| 2018/0284186 | A1 | 10/2018 | Chadha et al. |
| 2018/0343711 | A1 | 11/2018 | Wixforth et al. |
| 2018/0351261 | A1 | 12/2018 | Kamo et al. |
| 2019/0006743 | A1 | 1/2019 | Kirino et al. |
| 2019/0013563 | A1 | 1/2019 | Takeda et al. |
| 2020/0021001 | A1 | 1/2020 | Mangaiahgari |
| 2020/0235453 | A1 | 7/2020 | Lang |
| 2020/0343612 | A1 | 10/2020 | Shi |
| 2021/0036393 | A1 | 2/2021 | Mangaiahgari |

FOREIGN PATENT DOCUMENTS

| | | | |
|---|---|---|---|
| CN | 2796131 | | 7/2006 |
| CN | 201383535 | | 1/2010 |
| CN | 103515682 | A | 1/2014 |
| CN | 104900956 | A | 9/2015 |
| CN | 105609909 | A | 5/2016 |
| CN | 105680133 | A | 6/2016 |
| CN | 105958167 | B | 3/2019 |
| CN | 209389219 | U | 9/2019 |
| DE | 102019200893 | A1 | 7/2020 |
| EP | 2500978 | B1 | 7/2013 |
| EP | 2843758 | A1 | 3/2015 |
| EP | 3460903 | A1 | 3/2019 |
| GB | 2489950 | A | 10/2012 |
| JP | 2003289201 | A | 10/2003 |
| KR | 20080044752 | A | 5/2008 |
| WO | 2013189513 | A1 | 12/2013 |
| WO | 2018003932 | A1 | 1/2018 |

OTHER PUBLICATIONS

"Extended European Search Report", EP Application No. 20166797, dated Sep. 16, 2020, 11 pages.

"Extended European Search Report", EP Application No. 21197267.4, dated Feb. 18, 2022, 7 pages.

"Foreign Office Action", CN Application No. 201810122408.4, dated Jun. 2, 2021, 15 pages.

"Foreign Office Action", CN Application No. 201810122408.4, dated Oct. 18, 2021, 19 pages.

Jankovic, et al., "Stepped Bend Substrate Integrated Waveguide to Rectangular Waveguide Transitions", Jun. 2016, 2 pages.

Pan, et al., "A Narrow-wall Complementary-split-ring Slotted Waveguide Antenna for High-power-microwave Applications", Oct. 26, 2018, 126 pages.

Tytgat, et al., "A 90-GHz receiver in 40-nm CMOS for plastic waveguide links", Oct. 27, 2014, 11 pages.

Wang, et al., "Mechanical and Dielectric Strength of Laminated Epoxy Dielectric Graded Materials", 2020, 15 pages.

* cited by examiner

100

PLASTIC AIR-WAVEGUIDE ANTENNA WITH CONDUCTIVE PARTICLES

CROSS-REFERENCE TO RELATED APPLICATION

This application is a continuation of U.S. patent application Ser. No. 17/061,675, filed Oct. 2, 2020, the entire disclosure of which is hereby incorporated herein by reference.

BACKGROUND

Radar systems use electromagnetic signals to detect and track objects. The electromagnetic signals are transmitted and received using one or more antennas. An antenna may be characterized in terms of gain, beam width, or, more specifically, in terms of the antenna pattern, which is a measure of the antenna gain as a function of direction. Antenna arrays use multiple antenna elements to provide increased gain and directivity over what can be achieved using a single antenna element. In reception, signals from the individual elements are combined with appropriate phases and weighted amplitudes to provide the desired antenna pattern. Antenna arrays are also used in transmission, splitting signal power between the elements, and using appropriate phases and weighted amplitudes to provide the desired antenna pattern.

In some configurations, the radar system includes a circuit board with metal patch antenna elements that are connected by etched copper traces. In these configurations, the integrated circuit packages that drive and control the radar system are soldered to the circuit board on the same side as the antenna. This means that the primary heat dissipation path runs through the solder to the circuit board, which can limit the thermal operating range of the radar system. This antenna configuration can also limit its use in at least two other ways. First, even when using multiple antenna elements, gain and performance features may not be adequate for some applications. Second, the weight of metal antennas can be problematic in some applications. It is therefore desirable to increase gain while maintaining pattern variability and reducing weight, and without introducing additional hardware, complexity, or cost.

SUMMARY

This document describes techniques, apparatuses, and systems of a plastic air-waveguide antenna with electrically conductive particles. The described antenna includes an antenna body made from a plastic resin embedded with electrically conductive particles, a surface of the antenna body that includes a resin layer without the conductive particles, and a waveguide structure. The waveguide structure can be made from a portion of the surface of the antenna structure on which the embedded conductive particles are exposed. For example, the waveguide structure can be conductive channels on the surface of the antenna body. The waveguide structure can be molded as part of the antenna body or cut into the antenna body using a laser, which also exposes the conductive particles. If the waveguide is molded as part of the antenna body, the conductive particles can be exposed by an etching process or by using the laser. Additionally, multiple antenna bodies can be assembled or stacked together to form an antenna array with complex waveguide patterns. In this way, the described apparatuses and techniques can reduce weight, increase gain and phase control, improve high-temperature performance, and avoid expensive vapor-deposition plating operations.

For example, an antenna includes an antenna structure, which includes an antenna body made from a resin embedded with conductive particles. The antenna body also has a surface that includes a resin layer without the embedded conductive particles. The antenna also includes a waveguide structure that includes a portion of the surface of the antenna structure on which the embedded conductive particles are exposed.

This document also describes methods for manufacturing the above-summarized apparatuses. For example, one method includes forming an antenna structure from a resin embedded with conductive particles by at least including a surface comprising a resin layer without the conductive particles. The method also includes providing a waveguide structure on the surface of the antenna structure by exposing the embedded conductive particles on at least a portion of the surface of the antenna structure.

Another method for manufacturing the above-summarized apparatuses includes forming an antenna structure from a resin embedded with conductive particles by at least including a surface in the antenna structure that comprises a resin layer without the embedded conductive particles and a waveguide structure. The other method also includes exposing the embedded conductive particles on a portion of the surface of the antenna structure that comprises the waveguide structure.

This Summary introduces simplified concepts related to a plastic air waveguide antenna with conductive particles, which are further described below in the Detailed Description and Drawings. This Summary is not intended to identify essential features of the claimed subject matter, nor is it intended for use in determining the scope of the claimed subject matter.

BRIEF DESCRIPTION OF THE DRAWINGS

The details of one or more aspects of a plastic air waveguide antenna with conductive particles are described in this document with reference to the following figures. The same numbers are often used throughout the drawings to reference like features and components.

DETAILED DESCRIPTION

Overview

Figure 1:
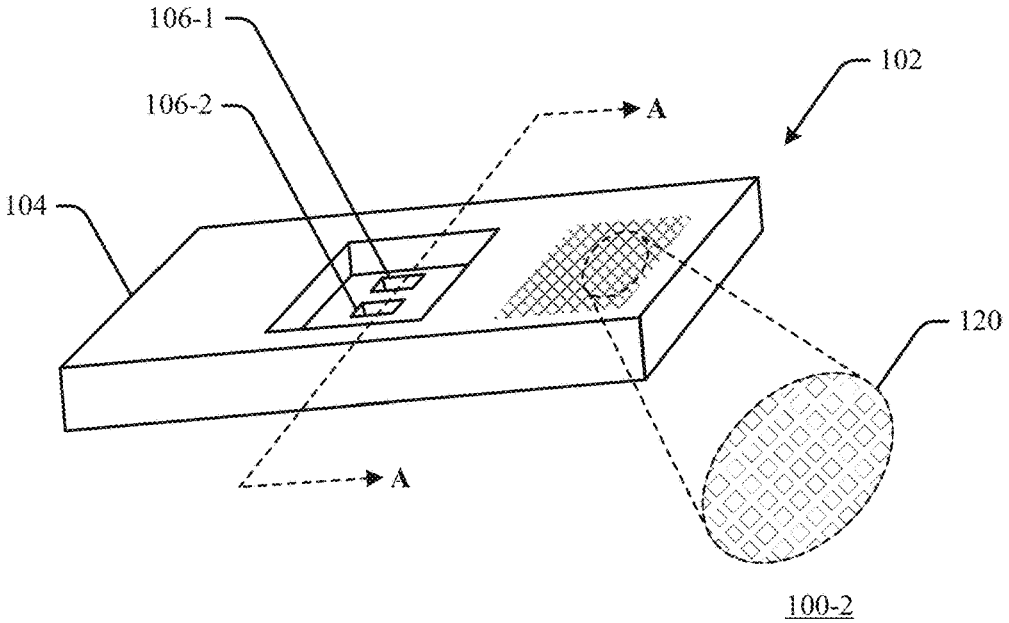
FIG. 1 illustrates an example implementation of a plastic air-waveguide antenna with conductive particles.
Figure 1:
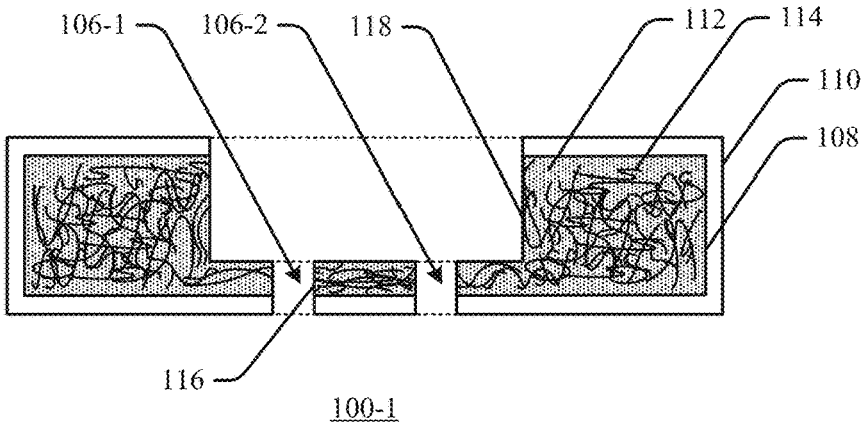

Radar systems are an important sensing technology used in many industries, including the automotive industry, to acquire information about the surrounding environment. An antenna is used in radar systems to transmit and receive electromagnetic (EM) energy or signals. Some radar systems use multiple antenna elements in an array to provide increased gain and directivity over what can be achieved using a single antenna element. In reception, signals from the individual elements are combined with appropriate phases and weighted amplitudes to provide the desired antenna reception pattern. Antenna arrays are also used in transmission, splitting signal power amongst the elements, again using appropriate phases and weighted amplitudes to provide the desired antenna transmission pattern.

A waveguide can be used to transfer EM energy to and from the antenna elements. Further, waveguides can be arranged to provide the desired phasing, combining, or splitting of signals and energy. For example, a conductive channel on the surface of or through the radar antenna array elements can be used as a waveguide.

Some radar systems use arrays of metal patch antenna elements on a circuit board that are connected by copper traces. This kind of radar system may therefore require vapor metal deposition and etching for the traces. Further, the integrated circuit package that drives and controls the radar system may be soldered to the circuit board on the same side as the antenna. This means that the primary heat dissipation path is through the solder to the circuit board, which can limit the thermal operating range of the radar system. The metal antennas in this antenna array configuration may also contribute to increased weight of the system in which it is implemented, such as an automobile or other vehicle. Additionally, even using multiple antenna elements, gain, beam-forming, or other performance features may not be adequate for some applications.

In contrast, this document describes techniques, apparatuses, and systems of a plastic air-waveguide antenna with conductive particles. The described antenna includes an antenna body made from a resin that is embedded with conductive particles, a surface of the antenna body that includes a resin layer without the conductive particles, and a waveguide structure. The waveguide structure can be made from a portion of the surface of the antenna structure on which the embedded conductive particles are exposed. For example, the waveguide structure can be a conductive channel that is molded as part of the antenna body or cut into the antenna body using a laser, which also exposes the conductive particles. If the waveguide is molded as part of the antenna body, the conductive particles can be exposed by an etching process or by using the laser. Additionally, multiple antenna bodies may be assembled or stacked together to form an antenna array with complex waveguide patterns. This allows the antenna to be attached to a radar system in a way that enables an improved path for heat dissipation. Further, the described apparatuses and techniques can reduce weight by eliminating some metal components required by other radar systems for heat dissipation, while improving gain and phase control, improving high-temperature performance, and avoiding at least some of the vapor-deposition plating operations described above.

This is just one example of the described techniques, apparatuses, and systems of a plastic air waveguide antenna with conductive particles. This document describes other examples and implementations.

Example Apparatuses

FIG. 1 illustrates generally at 100, an example implementation 102 of a plastic air-waveguide antenna with conductive particles (antenna 102). Some details of the example antenna 102 are illustrated in a detail view 100-1 as section view A-A. As shown, the example antenna 102 includes an antenna structure 104 and a waveguide structure 106. The antenna structure 104 provides an overall shape of the antenna 102 and can also provide electromagnetic (EM) shielding or isolation for various components that produce, receive, and use EM signals or energy transmitted and received by the antenna 102. The waveguide structure 106 provides a conductive pathway for propagating the EM signals and/or energy. The antenna 102 may be formed using various techniques, examples of which include injection-molding, three-dimensional (3D) printing, casting, or computer numeric control (CNC) machining. The waveguide structure 106 may be formed as part of the antenna structure 104 (e.g., during injection-molding or another forming process) or added after the antenna structure 104 is formed, such as by cutting or etching the antenna structure 104. Additional details of example techniques for forming the antenna structure 104 and the waveguide structure 106 are described with reference to FIGS. 4, 5, and 6.

The antenna structure 104 includes an antenna body 108 and a surface of the antenna body 110 (surface 110). The antenna body 108 can be formed as any of a variety of shapes (e.g., circular, rectangular, or polygonal) and may be made from any of a variety of suitable materials, including a resin 112 with embedded conductive particles 114. The resin 112 may be a polymer, a plastic, a thermoplastic, or another material that can be formed with the conductive particles 114, including, for example, resins based on polytetrafluoroethylene (PTFE), polyetherimide (PEI), or polyether ether ketone (PEEK). The conductive particles 114 may be any of a variety of suitable materials that can conduct electromagnetic (EM) signals or energy (e.g., stainless steel, aluminum, bronze, carbon graphite, or any combination thereof, including alloys or composites). Additionally, the antenna body 108 may include between approximately 20 percent and approximately 60 percent conductive particles 114 (e.g., approximately 20 percent, approximately 40 percent, or approximately 60 percent). As shown in the detail view 100-1, the conductive particles 114 are fibers (e.g., strands of conductive material), but the conductive particles 114 may be made in any of a variety of shapes and dimensions (e.g., crystals, pellets, flakes, or rods). The surface 110 can be a layer of the resin 112 that does not include the embedded conductive particles 114 (or includes very few conductive particles, making the surface 110 nonconductive or nearly nonconductive). For example, if the antenna body 108 is made by injection-molding, the surface 110 may be a skin that forms at or near the exterior of the antenna body 108 as the mold cools.

The waveguide structure 106 can provide the conductive pathway for propagating the EM signals or energy in various manners to provide the desired phasing and combining/splitting of signals for different reception and transmission patterns or to provide shielding or isolation. For example, the waveguide structure 106 can be a portion of the surface 110 on which the embedded conductive particles are exposed, which is shown as a conductive surface 116 in the detail view 100-1. In FIG. 1, the waveguide structure 106 includes two pathways (waveguide structure 106-1 and waveguide structure 106-2) through the antenna body 108. In other examples, the waveguide structure 106 can be a channel that is molded, laser-cut, or etched into the antenna body 108 or the surface 110 to expose the conductive particles 114 (e.g., using a laser, a laser-direct imaging process, or chemical etching to remove the surface 110 or a portion of the antenna body 108 and expose the conductive particles 114). In these examples, the waveguide is air (e.g., air is the dielectric), and the wall of the channel is conductive. In some implementations, the antenna structure 104 may include additional areas of the surface 110 on which the embedded conductive particles 114 are exposed. For example, an exposed surface 118 may be included on a portion of the surface 110 in addition to the waveguide structure. Further, the entire surface 110 may be removed in some cases.

In some implementations (not shown in FIG. 1), at least a portion of the antenna structure 104 may be coated with a conductive coating, either before or after all or a portion of the surface 110 is removed. For example, the waveguide structure 106 may be coated with a conductive material (e.g., copper) to improve EM conductivity. In other examples, the entire antenna structure 104 may be coated with the conductive material. The conductive coating may be applied using any of a variety of techniques, such as chemical plating, deposition, or painting. The conductive coating can increase the EM energy output of the antenna 102 (e.g., increase transmission power), which may enable the antenna 102 to be used in lower-loss applications or applications that require additional power (e.g., without adding additional antennas).

In some implementations, the antenna structure 104 may include a conducting pattern, an absorbing pattern, or both conducting and absorbing patterns on the surface 110. The conducting or absorbing patterns can be formed on another portion of the surface 110 that is not the waveguide structure. For example, a ground plane may be formed by removing a portion of the surface 110 or a portion of the antenna body 108. Further, in addition to or instead of a ground plane, a type of electromagnetic bandgap (EBG) structure can be formed on a portion of the surface 110 by removing the surface 110 or a portion of the antenna body 108 in various patterns, such as cross-hatched areas, arrays of dimples, or slotted areas. An example EBG structure 120 with a cross-hatch patter is shown in a detail view 100-2. EBG structures can absorb or reflect EM energy or signals by restricting the propagation of the EM energy or signals at different frequencies or directions that are determined by the shape and size of the EBG structure (e.g., by the configuration of the pattern of removed material). The EBG can provide additional options and flexibility for reception and transmission patterns. The surface 110 may be removed to form the ground plane or EBG structures in a variety of manners, such as by etching, lasering, or cutting the surface 110.

Figure 2:
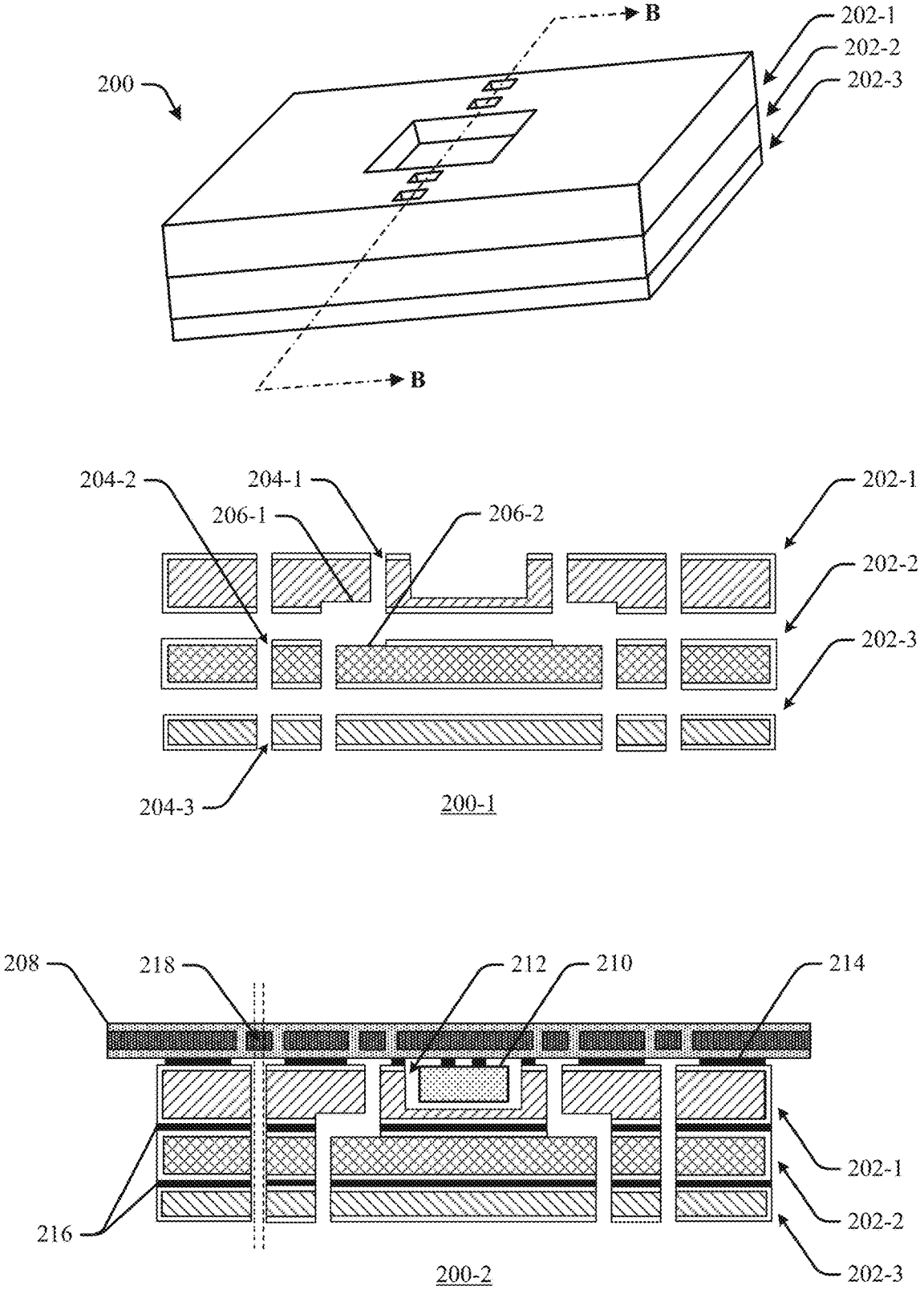
FIG. 2 illustrates an example antenna assembly that includes multiple antennas.

Additionally, multiple antennas (e.g., the antenna 102) may be assembled to form a three-dimensional antenna assembly (e.g., a layered stack or array) of antennas that are electrically connected to each other. A multiple-antenna array can provide increased gain and directivity compared to a single antenna element. In reception, signals from the individual elements are combined with appropriate phases and weighted amplitudes to provide the desired antenna pattern. Antenna arrays can also be used in transmission to split signal power between the elements, again using appropriate phases and weighted amplitudes to provide the desired antenna pattern. Consider FIG. 2, which illustrates an example antenna assembly 200. A detail view 200-1 illustrates the example antenna assembly 200, which includes three antennas 202 as a section view B-B (not to scale). Additionally, for clarity in the detail view 200-1, the antennas 202 are shown separated (spaced apart), and some components of the example antenna assembly 200 may be omitted or unlabeled.

As shown in the detail view 200-1, the example antenna assembly 200 includes three antennas 202, which are electrically connected to each other. For example, the antennas 202 may be electrically connected to each other using a conductive adhesive (not shown). In other cases, all or part of the antennas 202 may be coated with a solderable material (e.g., nickel, tin, silver, or gold) and soldered together. The antennas 202-1, 202-2, and 202-3 include an antenna structure (not labeled in the detail view 200-1). The antenna structure provides the overall shape of the antenna 202 and can also provide EM shielding or isolation for various components that produce and use EM signals or energy transmitted and received by the antenna 202 (e.g., as described with reference to the antenna structure 104 of FIG. 1). The antenna structure includes a body and a surface (not labeled in the detail view 200-1). The body can be made from a resin that is embedded with conductive particles, and the surface can be a layer of resin that includes few or no conductive particles (e.g., similar to the antenna body 108 and the surface 110 as described with reference to FIG. 1).

The antennas 202-1, 202-2, and 202-3 also include a waveguide structure 204. The waveguide structures 204 provide the conductive pathway for propagating the EM signals or energy in various manners to provide different reception and transmission patterns or provide shielding or isolation. The waveguide structure can be a portion of the antenna 202 from which the surface has been removed to expose the conductive particles (e.g., as described with reference to the waveguide structure 106 of FIG. 1). The waveguide structures 204 can be different for the respective antennas 202. For example, the waveguide structure 204-1 includes four conductive pathways through the antenna 202-1 and an additional conductive surface 206-1. Similarly, the waveguide structure 204-2 includes four conductive pathways through the antenna 202-2 and an additional conductive surface 206-2. The waveguide structure 204-3 includes four conductive pathways through the antenna 202-3. The conductive surface 206-1 and the conductive surface 206-2 form a part of a conductive pathway through the antenna assembly 200 (e.g., a portion of a waveguide) when the antennas 202-1 and 202-2 are assembled. These are only a few examples of configurations and arrangements of the waveguide structure 204.

In some implementations, the antennas 202 may also be attached to a substrate, such as a printed circuit board (PCB) along with other components, including an integrated circuit (IC) that can drive or control the EM energy or signals. Another detail view 200-2 illustrates the example antenna assembly 200 attached to a PCB 208 that includes an IC 210. As shown, a cavity 212 that the IC 210 occupies does not include the surface layer of resin that includes few or no conductive particles. In some implementations, however, the cavity 212 may include the surface layer for EM isolation. The PCB 208 and the example antenna assembly are attached to each other by an electrically connective layer 214. Similarly, the antennas 202 are electrically connected to each other through other electrically connective layers 216. The electrically connective layers 214 and 216 may be, for example, a solder layer (e.g., a lower-temperature solder for a reflow or other process), a conductive adhesive (e.g., a conductive epoxy), or a silver sinter layer. In some implementations, the PCB 208 also includes one or more radio frequency (RF) ports 218. In the detail view 200-2, there are four RF ports 218 (only one is labeled), and an alignment of the RF ports 218 with the waveguide structure 204 is indicated with dashed lines. This configuration of the IC 210 and the antenna assembly 200 can allow a path for heat dissipation from the IC 210 through the antenna assembly 200, which can improve the performance of the radar module (e.g., the IC 210 and associated components) in higher-temperature environments.

Figure 3:
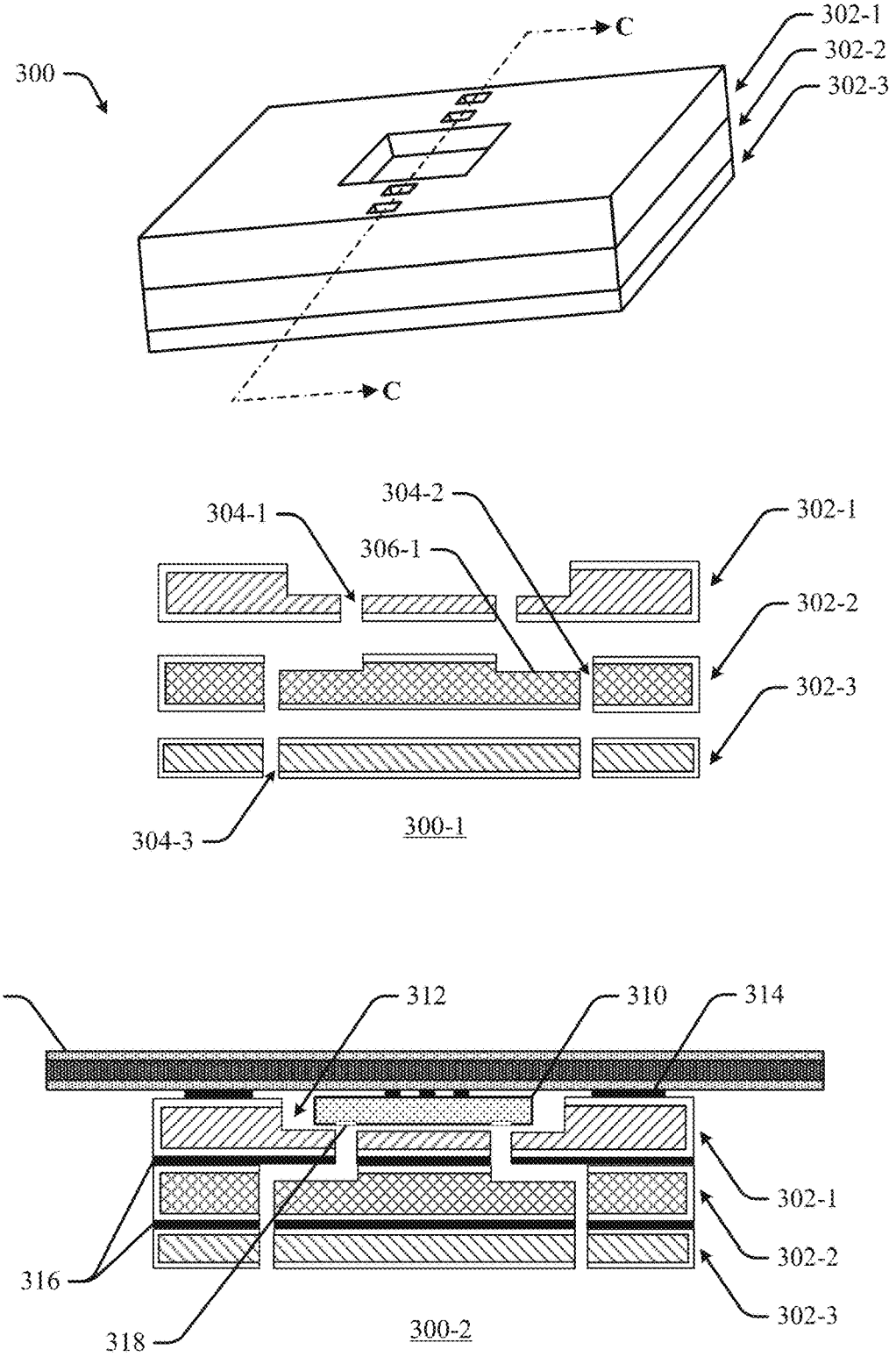
FIG. 3 illustrates another example antenna assembly that includes multiple antennas.

FIG. 3 illustrates another example antenna assembly 300. A detail view 300-1 illustrates the example antenna assembly 300, which includes three antennas 302, as a section view C-C (not to scale). Additionally, for clarity in the detail view 300-1, the antennas 302 are shown separated (spaced apart), and some components of the example antenna assembly 300 may be omitted or unlabeled.

As shown in the detail view 300-1, the example antenna assembly 300 includes three antennas 302, which are electrically connected to each other. For example, the antennas 302 may be electrically connected to each other using a conductive adhesive (not shown). In other cases, all or part of the antennas 302 may be coated with a solderable material (e.g., nickel, tin, silver, or gold) and soldered together. The antennas 302-1, 302-2, and 302-3 include an antenna structure (not labeled in the detail view 300-1). The antenna structure provides the overall shape of the antenna 302 and can also provide EM shielding or isolation for various components that produce and use EM signals or energy transmitted and received by the antenna 302 (e.g., as described with reference to the antenna structure 104 of FIG. 1). The antenna structure includes a body and a surface (not labeled in the detail view 300-1). The body can be made from a resin that is embedded with conductive particles, and the surface can be a layer of resin that includes few or no conductive particles (e.g., similar to the antenna body 108 and the surface 110 as described with reference to FIG. 1).

The antennas 302-1, 302-2, and 302-3 also include a waveguide structure 304. The waveguide structures 304 provide the conductive pathway for propagating the EM signals or energy in various manners to provide different reception and transmission patterns or provide shielding or isolation. The waveguide structure can be a portion of the antenna 302 from which the surface has been removed to expose the conductive particles (e.g., as described with reference to the waveguide structure 106 of FIG. 1). The waveguide structures 304 can be different for the respective antennas 302. For example, the waveguide structure 304-1 includes two conductive pathways through the antenna 302-1. Similarly, the waveguide structure 304-2 includes two conductive pathways through the antenna 302-2 and a conductive surface 306-1. The conductive surface 306-1 forms a part of a conductive pathway through the antenna assembly 300 (e.g., a portion of a waveguide) when the antennas 302-1 and 302-2 are assembled. The waveguide structure 304-3 includes two conductive pathways through the antenna 302-3. These are only a few examples of configurations and arrangements of the waveguide structure 304.

In some implementations, the antennas 302 may also be attached to a substrate, such as a printed circuit board (PCB) along with other components, including an integrated circuit (IC) that can drive or control the EM energy or signals. Another detail view 300-2 illustrates the example antenna assembly 300 attached to a PCB 308 that includes an IC 310. As shown, a cavity 312 that the IC 310 occupies does not include the surface layer of resin that includes few or no conductive particles. In some implementations, however, the cavity 312 may include the surface layer for EM isolation. The PCB 308 and the example antenna assembly are attached to each other by an electrically connective layer 314. Similarly, the antennas 302 are electrically connected to each other through other electrically connective layers 316. The electrically connective layers 314 and 316 may be, for example, a solder layer or a conductive adhesive. In some implementations, the IC 310 also includes one or more radio frequency (RF) ports 318. In the detail view 300-2, there are two RF ports 318 (only one is labeled) that align with an opening to the waveguide structure 304. This configuration of the IC 310 and the antenna assembly 300 can allow a path for heat dissipation from the IC 310 through the antenna assembly 300, which can improve the performance of the radar module (e.g., the IC 310 and associated components) in higher-temperature environments.

Example Methods

Figure 4:
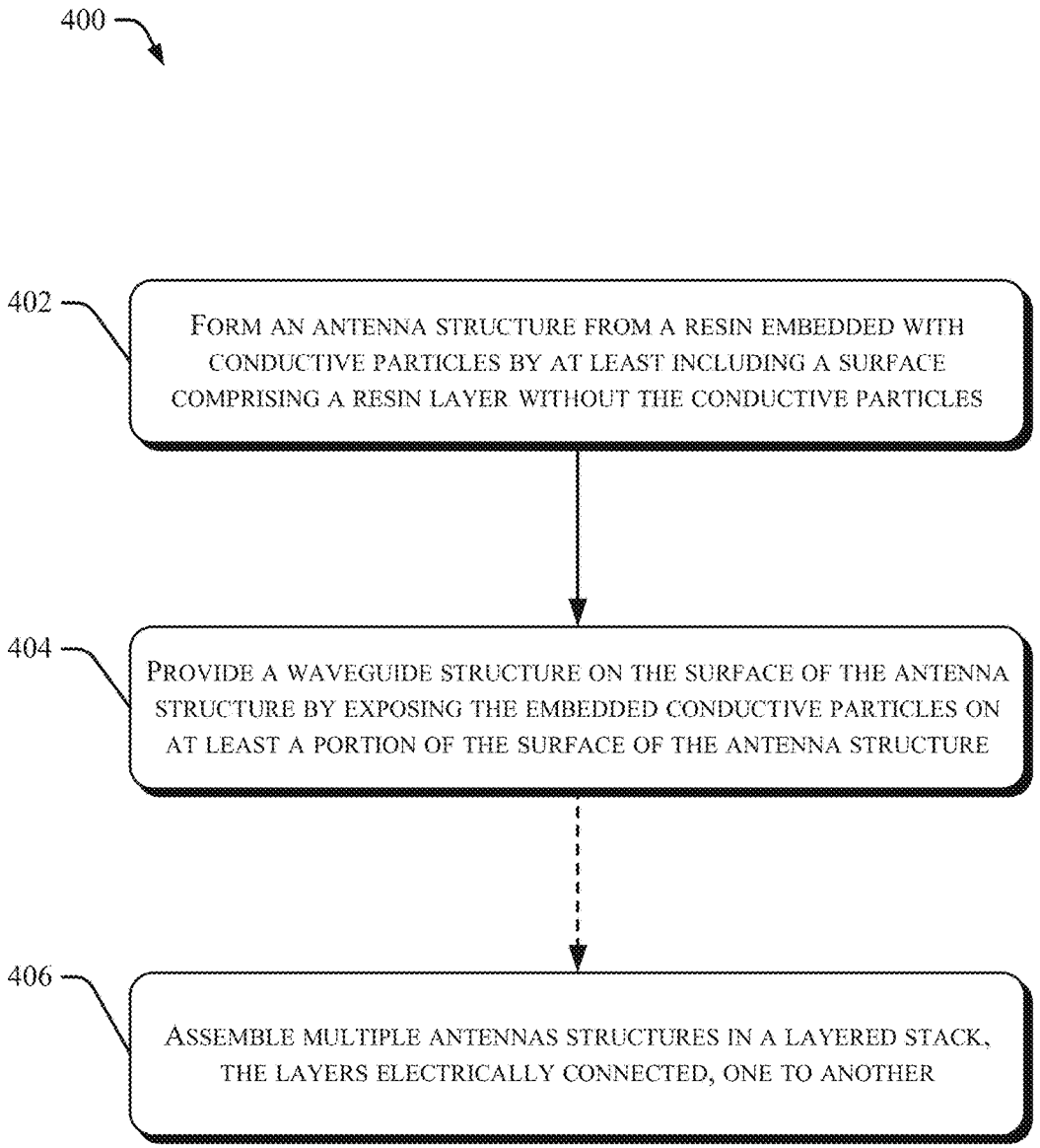
FIG. 4 depicts an example method that can be used for manufacturing a plastic air-waveguide antenna with conductive particles.
Figure 5:
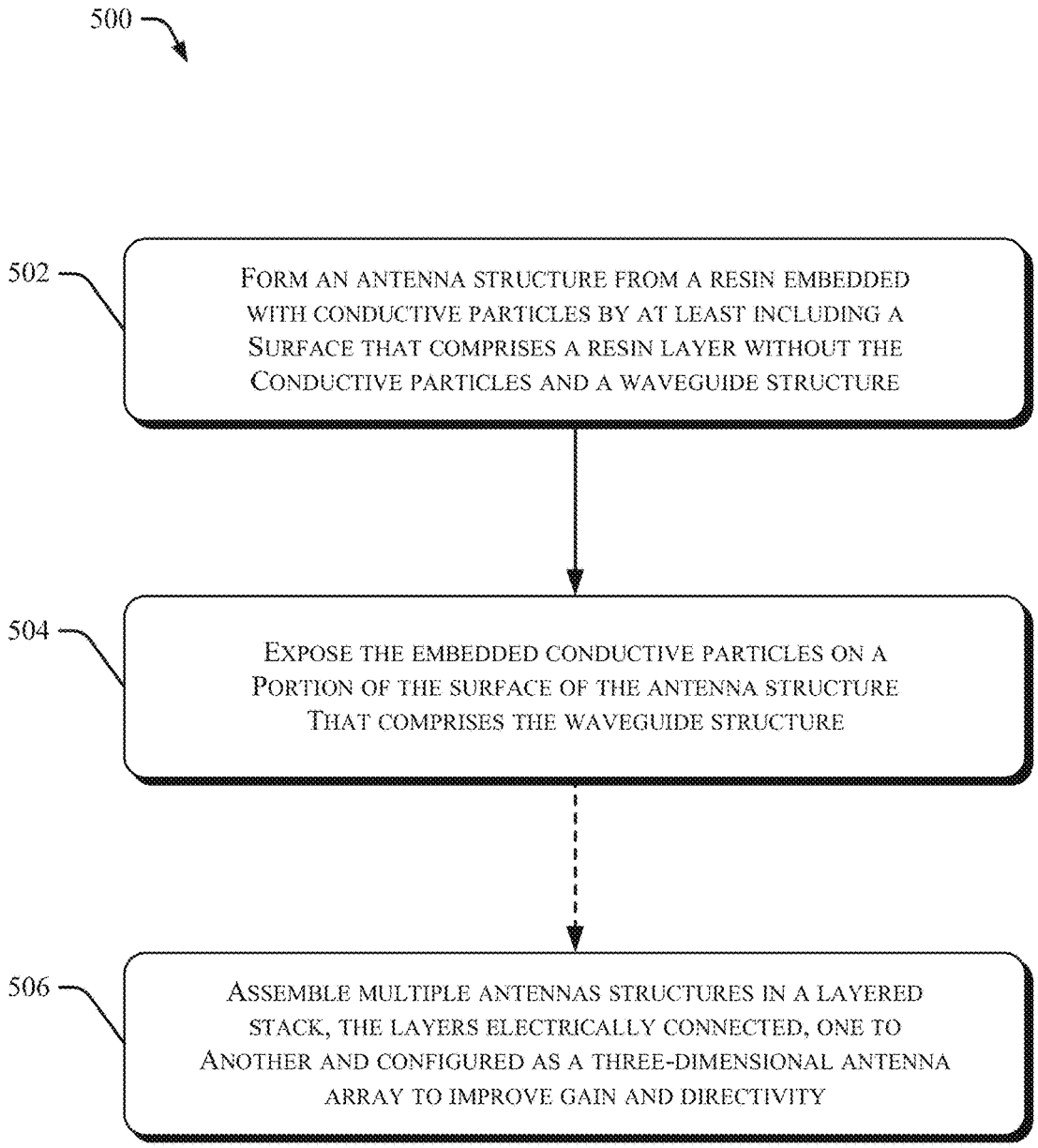
FIG. 5 depicts another example method 500 that can be used for manufacturing a plastic air-waveguide antenna with conductive particles.

FIG. 4 and FIG. 5 depict example methods of manufacturing a plastic air-waveguide antenna with conductive particles. The methods 400 and 500 are shown as sets of operations (or acts) performed, but not necessarily limited to the order or combinations in which the operations are shown herein. Further, any of one or more of the operations may be repeated, combined, or reorganized to provide other methods. In portions of the following discussion, reference may be made to the example antenna 102 of FIG. 1 and to entities detailed in FIG. 2 and FIG. 3, reference to which is made only for example. The techniques are not limited to performance by one entity or multiple entities.

FIG. 4 depicts an example method 400 that can be used for manufacturing a plastic air-waveguide antenna with conductive particles. At 402, an antenna structure is formed from a resin embedded with conductive particles by at least including a surface comprising a resin layer without the conductive particles (or with so few conductive particles as to be nonconductive or nearly nonconductive). The antenna structure provides an overall shape of the antenna structure and can also provide electromagnetic (EM) shielding or isolation for various components that produce, receive, and use EM signals or energy transmitted and received by the antenna. For example, the antenna structure 104, including the antenna body 108 and the surface 110 can be formed using any of the materials and techniques described with reference to FIG. 1 (e.g., injection molding, 3D printing, casting, or CNC machining). In other implementations, one or more of the antenna structures of the antennas 202 of FIG. 2, or one or more of the antenna structures of the antennas 302 of FIG. 3, can be formed using the described materials and techniques.

At 404, a waveguide structure is provided on the surface of the antenna structure by exposing the embedded conductive particles on at least a portion of the surface of the antenna structure. The waveguide structure can provide the conductive pathway for propagating the EM signals or energy in various manners to provide different reception and transmission patterns or provide shielding or isolation. For example, the waveguide structure 106 can be provided on the antenna structure (e.g., any of the waveguide structures described with reference to act 402). In other implementations, one or more of the waveguide structures 204 of FIG. 2 or one or more of the waveguide structures 304 of FIG. 3 can be provided on any of the described antenna structures.

The waveguide structure may be provided using any of a variety of techniques. For example, the waveguide structure can be formed or cut into the surface of the antenna structure by using a laser to form a conductive channel. The conductive channel may be formed by using the laser to remove a portion of the surface or body of the antenna structure (e.g., the antenna body 108 or the surface 110) to expose the conductive particles (e.g., the conductive particles 114). The laser may be any of a variety of suitable lasers, including, for example, a neodymium-doped yttrium aluminum garnet (Nd YAG) laser. The power level of the Nd YAG laser may be between approximately 10 watts and approximately 100 watts (e.g., approximately 10 watts, approximately 20 watts, or approximately 40 watts). Using the laser to provide the waveguide structure can allow higher-precision in shaping the waveguide structure, which may allow more flexibility in designing transmission and reception patterns and thereby improve performance of the system in which the antennas are operating.

In some implementations, additional embedded conductive particles on another portion of the surface of the antenna structure (e.g., the surface 110) may be exposed (e.g., to provide an additional conductive surface). The additional portion of the surface may be adjacent to the waveguide structure or on another part of the antenna structure, and, in some cases, the additional portion may include the entire surface. The additional surface can be removed using any of a variety of techniques, including the laser or a chemical etching process.

In other implementations, at least a portion of the antenna structure may be coated with a conductive coating. The conductive coating (e.g., copper) can be applied before or after the additional portion of the surface is removed. For example, the waveguide or the entire antenna structure may be coated with the conductive material. The conductive coating may be applied using any of a variety of techniques, as described with reference to FIG. 1. The conductive coating can increase the EM energy output of the antenna (e.g., increase transmission power), which may enable the antenna to be used in lower-loss application or applications that require additional power (e.g., without adding additional antennas).

In still other implementations, a conducting pattern, an absorbing pattern, or both conducting and absorbing patterns may be formed on the surface. The conducting or absorbing patterns can be formed adjacent to the waveguide structure or on another portion of the surface. For example, a ground plane or a type of electromagnetic bandgap (EBG) structure can be formed on a portion of the surface 110, as described with reference to FIG. 1. The EBG structures can absorb or reflect EM energy or signals by restricting the propagation of the EM energy or signals at different frequencies or directions that are determined by the shape and size of the EBG structure (e.g., by the configuration of the pattern of removed material). The ground plane or EBG structures may be formed using a variety of techniques, such as etching, laser-cutting, or mechanically cutting. The implementations describing enhancements and variations of the method 400 are not mutually exclusive; in other words, one or more of these implementations can be combined or re-ordered as part of the method 400.

Optionally, at 406, multiple antennas are assembled in a layered stack, the layers electrically connected, one to another. For example, multiple antennas 102, 202, or 302 may be assembled to form a three-dimensional antenna assembly (e.g., a layered stack or array) of antennas that are electrically connected to each other, such as the example antenna assemblies 200 and 300 of FIGS. 2 and 3. The antennas may be electrically connected to each other using a conductive adhesive or by coating the antennas with a solderable material (e.g., nickel, tin, silver, or gold) and soldering the antennas together.

FIG. 5 depicts another example method 500 that can be used for manufacturing a plastic air-waveguide antenna with conductive particles. At 502, an antenna structure is formed from a resin embedded with conductive particles by at least including a surface comprising a resin layer without the conductive particles (or with so few conductive particles as to be nonconductive or nearly nonconductive) and a waveguide structure. The antenna structure provides an overall shape of the antenna structure and can also provide EM shielding or isolation for various components that produce, receive, and use EM signals or energy transmitted and received by the antenna. For example, the antenna structure 104, including the antenna body 108 and the surface 110, can be formed using any of the materials and techniques described with reference to FIG. 11 (e.g., injection molding, 3D printing, casting, or CNC machining). In other implementations, one or more of the antenna structures of the antennas 202 of FIG. 2, or one or more of the antenna structures of the antennas 302 of FIG. 3, can be formed using the described materials and techniques.

The waveguide structure can provide the conductive pathway for propagating the EM signals or energy in various manners to provide different reception and transmission patterns or provide shielding or isolation. For example, the waveguide structure 106 can be included on the antenna structure (e.g., any of the waveguide structures described with reference to act 502). In other implementations, one or more of the waveguide structures 204 of FIG. 2 or one or more of the waveguide structures 304 of FIG. 3 can be provided on any of the described antenna structures. In some implementations, the waveguide structure is achieved by forming the antenna structure with a channel in the surface of the antenna structure. For example, the antenna structure 104 or any of the antenna structures of the antennas 202 or 302 can be formed (e.g., injection-molded) as a channel included in or on a portion of the surface of the antenna structure.

At 504, the embedded conductive particles on the portion of the surface of the antenna structure that comprises the waveguide structure are exposed. For example, the conductive particles 114 can be exposed on the portion of the surface 110 that covers the waveguide structure (e.g., any of the waveguide structures described at act 502). The conductive particles may be removed using any of a variety of techniques, including the laser (e.g., the Nd YAG laser described at act 404) or a chemical etching process, which can provide cost savings over the laser methods. In some implementations, additional embedded conductive particles on another portion of the surface of the antenna structure (e.g., the surface 110) may be exposed (e.g., to provide an additional conductive surface). The additional portion of the surface may be adjacent to the waveguide structure or on another part of the antennas structure, and, in some cases, the additional portion may include the entire remaining surface. The additional surface can be removed using a same or different process as used to remove the portion of the surface of the antenna structure that comprises the waveguide structure.

In other implementations, at least a portion of the antenna structure may be coated with a conductive coating. The conductive coating can be applied before or after the additional portion of the surface is removed. For example, the waveguide or the entire antenna structure may be coated with the conductive material (e.g., copper). The conductive coating may be applied using any of a variety of techniques, as described with reference to FIG. 1. The conductive coating can increase the EM energy output of the antenna (e.g., increase transmission power), which may enable the antenna to be used in lower-loss application or applications that require additional power (e.g., without adding additional antennas).

In still other implementations, a conducting pattern, an absorbing pattern, or both conducting and absorbing patterns may be formed on the surface. The conducting or absorbing patterns can be formed adjacent to the waveguide structure or on another portion of the surface. For example, a ground plane or a type of EBG structure can be formed on a portion of the surface 110, as described with reference to FIG. 1. The EBG structures can absorb or reflect EM energy or signals by restricting the propagation of the EM energy or signals at different frequencies or directions that are determined by the shape and size of the EBG structure (e.g., by the configuration of the pattern of removed material). The ground plane or EBG structures may be formed using a variety of techniques, such as etching, laser-cutting, or mechanically cutting. The implementations describing enhancements and variations of the method 500 are not mutually exclusive; in other words, one or more of these implementations can be combined or re-ordered as part of the method 500.

Optionally, at 506, multiple antennas are assembled in a layered stack, the layers electrically connected, one to another, and the layered stack of multiple antennas is arranged as a three-dimensional antenna array that can reduce signal loss (e.g., when transmitting or receiving). For example, multiple antennas 102, 202, or 302 may be assembled to form a three-dimensional antenna assembly (e.g., a layered stack or array) of antennas that are electrically connected to each other, such as the example antenna assemblies 200 and 300 of FIGS. 2 and 3. The antennas may be electrically connected to each other using a conductive adhesive or by coating the antennas with a solderable material (e.g., nickel, tin, silver, or gold) and soldering the antennas together.

Unless context dictates otherwise, use herein of the word "or" may be considered use of an "inclusive or," or a term that permits inclusion or application of one or more items that are linked by the word "or" (e.g., a phrase "A or B" may be interpreted as permitting just "A," as permitting just "B," or as permitting both "A" and "B"). Also, as used herein, a phrase referring to "at least one of" a list of items refers to any combination of those items, including single members. For instance, "at least one of a, b, or c" can cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c, or any other ordering of a, b, and c). Further, items represented in the accompanying figures and terms discussed herein may be indicative of one or more items or terms, and thus reference may be made interchangeably to single or plural forms of the items and terms in this written description.

EXAMPLES

The following section includes some additional examples of a plastic air-waveguide antenna with conductive particles.

Example 1: An antenna, comprising: an antenna structure, the antenna structure including: an antenna body made from a resin embedded with conductive particles; and a surface of the antenna body comprising a resin layer without the embedded conductive particles; and a waveguide structure, the waveguide structure comprising a portion of the surface of the antenna structure on which the embedded conductive particles are exposed.

Example 2: The antenna of example 1, wherein the antenna structure further comprises additional exposed embedded conductive particles on a portion of the surface of the antenna structure in addition to the waveguide structure.

Example 3: The antenna of example 1, wherein the antenna structure further comprises a conductive coating on at least a portion of the surface of the antenna structure.

Example 4: The antenna of example 1, wherein the antenna structure further comprises at least one of a conducting pattern or an absorbing pattern on the surface of the antenna structure, the at least one of a conducting or an absorbing pattern comprising another portion of the surface of the antenna structure that is not the waveguide structure.

Example 5: The antenna of example 1, wherein the antenna further comprises multiple antenna structures and multiple waveguides, the multiple antenna structures and multiple waveguides assembled in a layered stack, the layers electrically connected, one to another.

Example 6: A method of manufacturing an antenna, the method comprising: forming an antenna structure from a resin embedded with conductive particles by at least including a surface comprising a resin layer without the conductive particles; and providing a waveguide structure on the surface of the antenna structure by exposing the embedded conductive particles on at least a portion of the surface of the antenna structure.

Example 7: The method of example 6, wherein providing the waveguide structure further comprises cutting the waveguide structure into the surface of the antenna structure by using a laser to form a conductive channel.

Example 8: The method of example 7, further comprising: exposing additional embedded conductive particles on another portion of the surface of the antenna structure that is adjacent to the waveguide structure by using the laser to remove the resin layer on the other portion of the surface of the antenna structure.

Example 9: The method of example 7, further comprising: exposing additional embedded conductive particles on another portion of the surface of the antenna structure that is adjacent to the waveguide structure by etching the other portion of the surface of the antenna structure to remove the resin layer.

Example 10: The method of example 6, further comprising: applying a conductive coating to at least a portion of the exposed portion of the surface of the antenna structure.

Example 11: The method of example 6, further comprising: providing at least one of a conducting pattern or an absorbing pattern on the surface of the antenna structure by using a laser to remove another portion of the resin layer.

Example 12: The method of example 6, further comprising: providing at least one of a conducting pattern or an absorbing pattern on the surface of the antenna structure by etching another other portion of the surface of the antenna structure to remove the resin layer.

Example 13: The method of example 6, further comprising: assembling multiple antennas in a layered stack, the layers electrically connected, one to another.

Example 14: A method of manufacturing an antenna, the method comprising: forming an antenna structure from a resin embedded with conductive particles by at least including: a surface in the antenna structure that comprises a resin layer without the embedded conductive particles; and a waveguide structure; and exposing the embedded conductive particles on a portion of the surface of the antenna structure that comprises the waveguide structure.

Example 15: The method of example 14, wherein forming the antenna structure from the resin embedded with conductive particles by at least including the waveguide structure further comprises forming the antenna structure with a channel in the surface of the antenna structure.

Example 16: The method of example 14, wherein exposing the embedded conductive particles on the portion of the surface of the antenna structure that comprises the waveguide structure comprises etching at least the portion of the surface of the antenna structure that comprises the waveguide structure to remove the resin layer.

Example 17: The method of example 14, wherein exposing the embedded conductive particles on the portion of the surface of the antenna structure that comprises the waveguide structure comprises using a laser to remove the resin layer from at least the portion of the surface of the antenna structure that comprises the waveguide structure.

Example 18: The method of example 14, further comprising: applying a conductive coating to at least a portion of the exposed portion of the surface of the antenna structure to increase the electromagnetic (EM) energy output of the antenna.

Example 19: The method of example 14, further comprising: forming at least one of a conducting pattern or an absorbing pattern on the surface of the antenna structure using a laser or an etching process to remove the resin layer on another portion of the surface of the antenna structure.

Example 20: The method of example 14, further comprising; assembling multiple antennas in a layered stack, the layers electrically connected, one to another; and configuring the layered stack of multiple antennas as a three-dimensional antenna array to improve gain and directivity.

CONCLUSION

While various embodiments of the disclosure are described in the foregoing description and shown in the drawings, it is to be understood that this disclosure is not limited thereto but may be variously embodied to practice within the scope of the following claims. From the foregoing description, it will be apparent that various changes may be made without departing from the spirit and scope of the disclosure as defined by the following claims.

What is claimed is:

1. An antenna comprising:

an antenna structure made from a resin embedded with particles of a conductive material, the resin being a non-conductive material, the particles of the conductive material including fibers, strands, crystals, pellets, or flakes of the conductive material a surface of the antenna structure comprising:

a first portion of the surface comprising resin without the particles of the conductive material; and a second portion of the surface on which the particles of the conductive material are exposed, the second portion being a waveguide structure.

2. The antenna of claim 1, wherein the particles of the conductive material have a variety of shapes and dimensions within the antenna structure.

3. The antenna of claim 2, wherein the conductive material comprises at least one of stainless steel, aluminum, bronze, carbon graphite, any combination thereof, any alloys thereof, or any composites thereof.

4. The antenna of claim 1, wherein the resin embedded with the particles of the conductive material is made up of between twenty percent and sixty percent of the conductive material.

5. The antenna of claim 1, wherein the non-conductive material of the resin comprises at least one of a polymer, a plastic, or a thermoplastic.

6. Material of the resin comprises at least one of a material based on polytetrafluoroethylene (PTFE), polyetherimide (PEI), or polyether ether ketone (PEEK).

7. The antenna of claim 1, wherein the first portion of the surface is nonconductive.

8. The antenna of claim 1, wherein the surface of the antenna structure further comprises a third portion of the surface on which the particles of the conductive material are exposed, the third portion being adjacent to the second portion of the surface.

9. The antenna of claim 1, wherein the first portion comprises an absorbing pattern, the absorbing pattern being formed by removing a portion of the first portion of the surface in a pattern.

10. The antenna of claim 9, wherein the pattern of the absorbing pattern includes cross-hatches, dimples, or slots.

11. The antenna of claim 9, wherein the absorbing pattern comprises an electromagnetic bandgap structure.

12. The antenna of claim 1, wherein the antenna further comprises additional antenna structures, the antenna structures and the additional antenna structures being assembled in a layered stack, each layer of the layered stack being electrically connected.

13. The antenna of claim 12, wherein the layered stack is configured as a three-dimensional antenna array.

14. The antenna of claim 12, wherein each layer of the layered stack is electrically connected using a conductive adhesive.

15. The antenna of claim 12, wherein the layered stack comprises at least three antenna structures.

16. The antenna of claim 12, wherein the waveguide structure of each antenna structure of the layered stack has a different pattern than the waveguide structure of another antenna structure of the layered stack.

17. The antenna of claim 12, wherein the antenna structure is attached to a printed circuit board (PCB).

18. The antenna of claim 17, wherein the PCB also includes an integrated circuit to drive or control EM energy transmitted or received by the layered stack.

19. The antenna of claim 18, wherein the antenna structure is positioned on the PCB over the integrated circuit, the antenna structure including a cavity occupied by the integrated circuit.

20. The antenna of claim 17, wherein:

the PCB includes one or more radio frequency (RF) ports; and the antenna structure is positioned on the PCB to align the waveguide structure of the antenna structure with the one or more RF ports.

* * * * *